United States Patent [19]

Reuter

[11] Patent Number: 4,492,423

[45] Date of Patent: Jan. 8, 1985

[54] ROTATABLE HEAVY-CURRENT CONNECTOR

[75] Inventor: Wolfgang Reuter, Niddatal, Fed. Rep. of Germany

[73] Assignee: Leybold-Heraeus GmbH, Cologne, Fed. Rep. of Germany

[21] Appl. No.: 497,787

[22] Filed: May 25, 1983

[30] Foreign Application Priority Data

May 26, 1982 [DE] Fed. Rep. of Germany ..... 3219721

[51] Int. Cl.[3] ..... H01R 13/533; H01R 39/02

[52] U.S. Cl. ..... 339/112 L; 339/8 R

[58] Field of Search ..... 339/5 R, 112 L, 8 R

[56] References Cited

U.S. PATENT DOCUMENTS 2,575,409 11/1950 Cooper et al. ..... 339/112 L X 3,117,213 1/1964 Engström et al. ..... 339/112 L X

FOREIGN PATENT DOCUMENTS 2946227 5/1981 Fed. Rep. of Germany ..... 339/5 R 1013914 11/1954 France ..... 339/112 L 1410146 10/1975 United Kingdom ..... 339/112 L

*Primary Examiner*—Eugene F. Desmond

*Attorney, Agent, or Firm*—Felfe & Lynch

[57] ABSTRACT

A rotatable connector for heavy electric currents has a first annular flange unit coaxially in the annular space of a second annular flange unit. Inner and outer fluid-cooled conductors physically and electrically connect to the first flange unit. The conductors and first flange unit are rotatable relative to the second flange unit about the axis of the flange units. U-shaped stranded wires are embedded at their opposite ends in corresponding first and second flanges of the first and second flange units. The first flange of the first flange unit is cooled by the fluid cooling the outer conductor and the other flanges of the units are separately fluid cooled. The combination of embedding the stranded wires in the flanges and fluid cooling the flanges keeps the stranded wires cool enough for carrying heavy electric currents without corroding contact of the stranded wires with the cooling fluid.

3 Claims, 2 Drawing Figures

ROTATABLE HEAVY-CURRENT CONNECTOR

Figure 1:
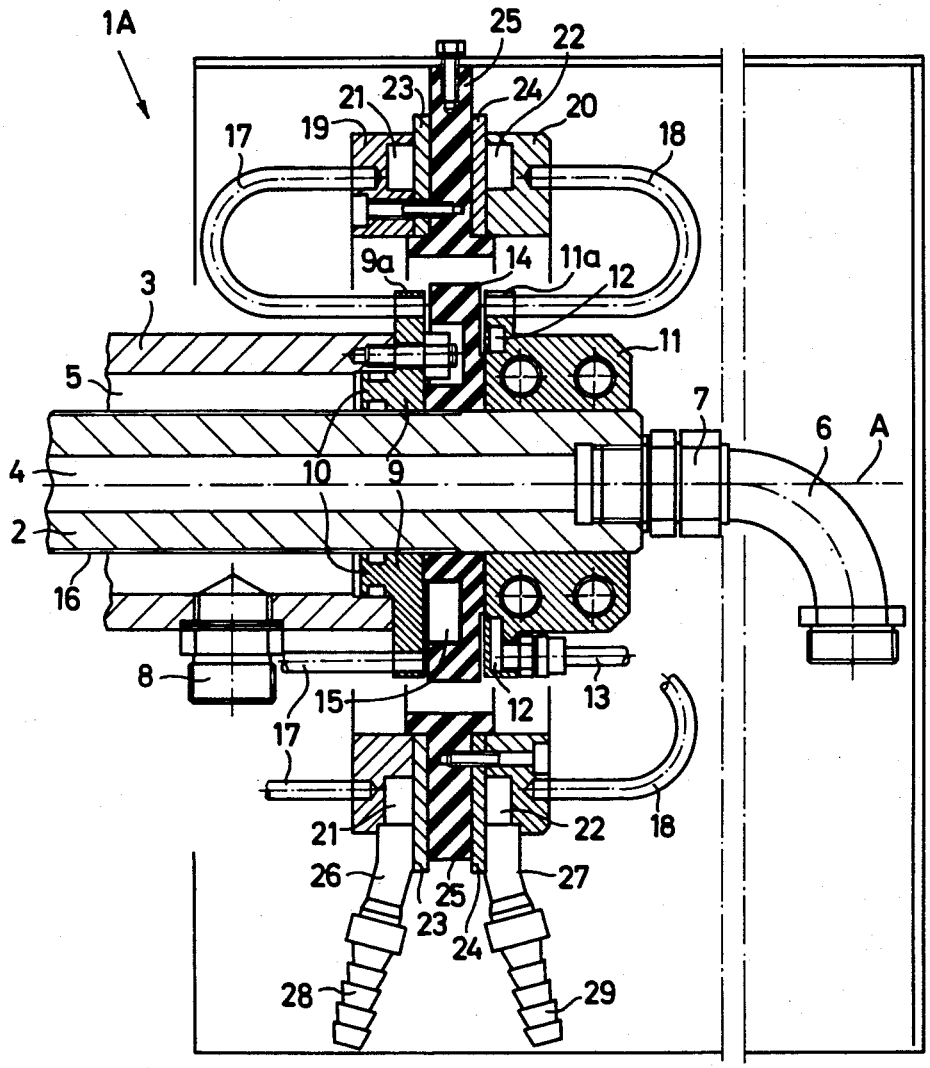

The invention concerns a rotatable connector for passing heavy electrical currents to movable components and, more particularly, doing so in enclosed spaces.

Heavy-current connections of the above-stated kind are used, for example, for passing heavy work currents into enclosed spaces when limited rotary and swivelling movements are to be executed between components inside and outside the walls delimiting these spaces. This need arises, for example, in the case of installations, such as melting and casting installations, which are supplied with electric current and in which the molten material is poured by tilting a crucible that is integral with the heating means.

In such cases, it is particularly important that the heavy-current connection should also be capable of being used for supplying and discharging a cooling medium whereby furnace parts, for example an induction coil, are protected against overheating.

In equipment in which pressure difference occur at the two sides of the walls delimiting the enclosed spaces, as in vacuum furnaces, for instance, special requirements are also imposed as regards the tightness of the heavy-current connections. However, heavy-current connections of the initially stated kind are not limited to use in melting and casting furnaces.

Zones of pronounced weakness in heavy-current connections of this kind are constituted by the inherently flexible parts which take the form of stranded wires consisting of thin copper elements.

One heavy-current connection of the initially described kind is well known since it has been in use for many years. This consists of four metallic annular flanges, which are concentrically arranged in pairs one within the other, and are interconnected by stranded wires bent to the shape of a letter U, the arrangement being such that the same potential is applied to an inner and an outer annular flange. The annular flanges, arranged back-to-back and having differing polarity, are electrically separated from each other by insulating rings, but from the mechanical point of view they form a single component, and the inner annular flanges are able to execute a limited swivelling movement relatively to the outer annular flanges. The ends of the stranded wires are secured to the flanges by means of clamping screws. The bundles of stranded wires are disposed in a substantially mirror-symmetrical arrangement in relation to the bundles of stranded wires of the other potential, the plane of symmetry lying approximately within the insulating rings between the flanges. An appropriate length of the loops of stranded wire ensures that the swivel angle is sufficiently great. The inner rotatable annular flanges are of differing inside diameter and they are mounted on the surfaces of the coaxial tubes, which transmit the current and the cooling medium through the wall delimiting the enclosed space and apply them to the movable components within the space.

Whereas, hitherto, the rigid coaxial tubes could be provided in adequate sizes and cooled sufficiently by the cooling water, the stranded wires were repeatedly endangered by overheating. This was due, on the one hand, to the contact resistance at the clamping zones and, on the other hand, to the ohmic resistance of the stranded wires which could not be kept sufficiently low in view of the necessary flexibility of the wires. An increase in the average diameter of the entire stranded wire system was inhibited for reasons of space. Nor did the fact that a cooling coil was brazed on to the surfaces of the outer flanges reduce overheating of the stranded wires. The known arrangement involving certain dimensions was therefore suitable only for a relatively low total current, so that the possibility of using the known heavy-current connection was strictly limited.

Efforts have therefore been made to find ways of cooling the stranded wires more effectively. This was achieved by disposing the stranded wires of one polarity in the cavity of the inner tube, and placing the stranded wires of the other polarity in the annular space between the inner tube and the coaxial outer tube, the tubes themselves being made of an insulating material. Such an arrangement is disclosed in DE-PS No. 23 18 690 and has proved very reliable in practice because of its high electrical loadability.

Experience has shown, however, that the stranded wires are subjected to heavy corrosion accompanied by calcereous deposits resulting from the cooling water flowing around them, so that the heavy-duty connections concerned had to be periodically replaced. The service life of the known heavy-current connections was sufficiently long, provided that the cooling water met certain standards as regards purity. Since, however, occasionally uncontrollable impurities in the water had to be accepted, it became necessary to remove the stranded wires again from the zone in which water was present. This, however, would have led to a drastic reduction in the specific loadability of the stranded wires.

The object of the present invention is, therefore, to provide a rotatable heavy-current connection of the initially described kind which—assuming the same dimensions—has substantially the same specific loadability as the above-described heavy-duty connections with stranded wires directly cooled by water, but which is not likely to suffer corrosion and therefore has a considerably lengthened service life.

According to the invention, this object is achieved in the case of the initial described heavy-current connection by a combination of the following features:

(a) the flange, non-torsionally connected to the outer tube, extends into the cavity between the outer tube and the inner tube in such manner that it can be brought into direct contact with the cooling medium, (b) the flange, non-torsionally connected to the inner tube, is provided with a cooling-medium duct, (c) the two counter-flanges, associated with the current conductors of fixed location, are likewise provided with internal cooling-medium ducts, and (d) the stranded wires are embedded at both of their ends in the associated flanges by means of metallic brazed connections.

Combination of these individual features results in the stranded wires and their brazed zones being cooled effectively and to a greater extent at several areas, the total effect of the various cooling actions resulting in efficient lowering of the temperature level as a whole.

The flange which is connected to the outer tube and which, in a known arrangement, was simply mounted on the surface of the tube and did not come directly into contact with the cooling water, now extends, by means of a radially inwardly directed extension possibly involving enlargement of the surface, into the space between the outer tube and the inner tube where it is directly cooled by the cooling water when the equipment is in operation, so that simply for this reason, reduction in temperature is achieved.

A similar principle of construction was used in the known arrangement also as regards that annular flange that was mounted on the surface of the inner tube. Here again, only indirect cooling was achieved. The provision of a cooling-medium duct in this flange and in fact, in the immediate vicinity of the areas where the stranded wires are brazed, enables the zone where the wires are clamped in to be effectively cooled in this case too.

Finally, the provision of cooling-medium ducts within the outer annular flanges and associated with the supply conductor of fixed location results in considerably more effective cooling in the immediate vicinity of the brazed areas than in the case of a cooling ring that is merely brazed on externally and three-quarters of the surface of which exchanges heat with the atmosphere but not with the annular flange.

Furthermore, because the ends of the stranded wires are brazed into the annular flanges concerned, the contact resistance, otherwise occurring at this zone, is drastically reduced, so that generation of heat occurs on a considerably smaller scale.

As already stated, interaction of all the individual features causes a reduction in temperature that is so drastic that the specific loading, with current, of the entire heavy-current connection can be considerably increased without the permissible temperature limits, imposed by the material used, being exceeded. Corrosion of the stranded wires by the cooling water is precluded, so that a considerably longer service life results for the heavy-current connection, even when considerable concessions have to be made as regards the purity of the cooling water.

That known arrangement that is equipped with plastics tubes movable relatively to each other, required a relatively high driving torque for turning the heavy-current connection because of the high coefficients of friction between the plastics parts. In the case of the subject-matter of the invention, this problem can also be solved because of the possibility of using metallic components, i.e., because the flanges of the inner tube and the outer tube are freely rotatable within the current conductor of fixed location. Since no sealing-off is involved in this zone, clearance of sufficient magnitude can be provided so as to give a substantially frictionless movement.

Figure 2:
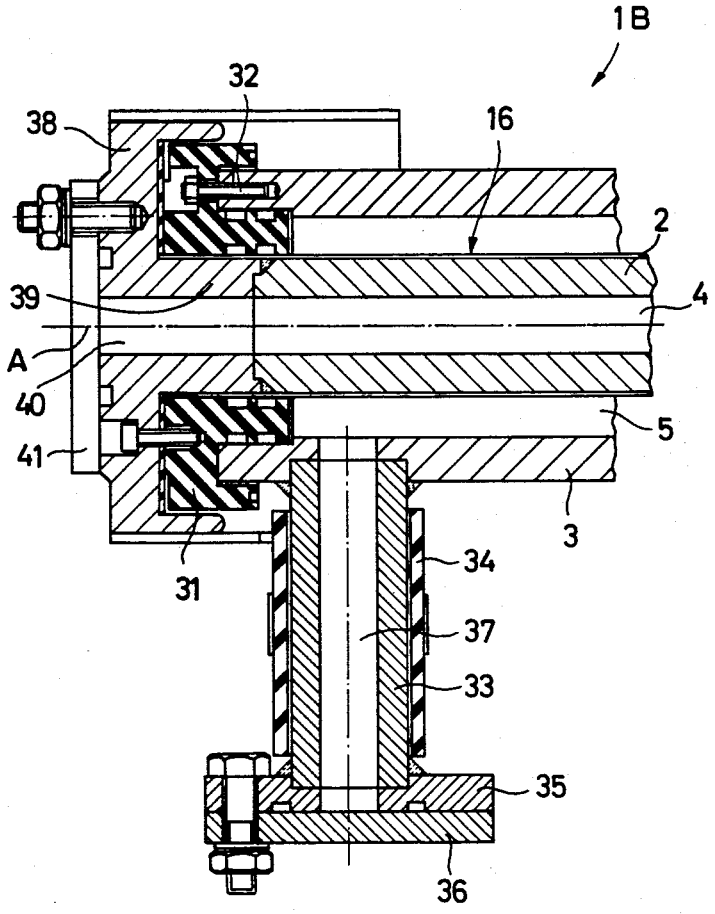

An example of the construction of the subject-matter of the invention will now be described in greater detail by reference to the drawings, in which:

FIG. 1 shows a section along the axis of that part of the heavy-current connection where the annular flanges of fixed location are connected, by way of stranded wires, to the rotatable annular flanges, and FIG. 2 is a section along the axis of the oppositely disposed and fully rotatable end of the heavy-current connection, together with the connecting elements for the swivellable consumer unit.

In FIGS. 1 and 2, the two ends of the rotatable heavy-current connection are designated 1A and 1B. Between these two ends is disposed that wall that delimits the enclosed space in which the end 1B is positioned. The wall in question is not illustrated, nor is the rotary duct, present at the point of penetration, since these items form part of the prior art.

The heavy-current connection comprises an electrically conducting inner tube 2 and a likewise electrically conducting outer tube 3 which, however, is of smaller length and is arranged concentrically in relation to the inner tube 2. The inner tube 2 has a cavity 4 for conveying a cooling medium; an annular cavity 5, which also serves to convey the cooling medium, is formed between the inner tube 2 and the outer tube 3. The inner cavity 4 is connected to a flexible cooling-medium pipe, not shown, by way of a tubular elbow 6 having a screw-threaded socket 7. By way of a lateral port 8, the outer cavity 5 is likewise connected to a flexible cooling-water pipe.

The end face, seen in FIG. 1, of the outer tube 3 is firmly connected to a metallic flange which, by means of an extension 10, projects into the cavity 5 and, during operation of the equipment, is thus in direct contact with the cooling medium contained in the cavity 5. To achieve accurate centering, the flange 9 is of L-shaped cross-section and is provided with two radial channels, not marked with reference numerals, in which are arranged seals, not illustrated, for closing off the flange from the outer tube 3, on the one hand, and from the inner tube 2, on the other. The inner tube and the outer tube do not rotate relatively to each other, since they form a rigid system which moves as one piece.

Similarly, a flange 11 is non-rotatably fitted on the inner tube 2 beyond the end face of the outer tube 3, which flange is likewise of L-shaped cross-section. In the zone of its radially outwardly directed limb cross-section, the flange 11 is provided with a cooling-medium duct 12, which can receive cooling-water through a connected pipe 13. A second connected pipe for returning the cooling-water is not illustrated, so as to keep the drawing simple.

Located between the two flanges 9 and 11 is a distance ring 14 which is made of an insulating material and has an axial channel 15 for accommodating those screws whereby the flange 9 is connected to the outer tube 3. Along part of its length, the inner tube 2 has an insulating coating 16 which extends into the distance ring 14, so that the predetermined potential difference between the flange 9 and the inner tube 2 can be maintained. The flanges 9 and 11 as well as the distance ring 14 cannot rotate relatively to each other and form a rigid group of components which can execute swivelling movements only in conjunction with the tube system.

Formed in each of the limbs **9*a* and 11*a* of the flanges 9 and 11, that extend radially outwards, is a plurality of equidistantly spaced axially directed drilled holes into which U-shaped stranded wires 17 and 18** respectively are brazed. The stranded wires of each polarity form a bunch, and the median lines of the wires in the middle of the swivel range lie in planes extending radially in relation to the axis A—A of the system.

The opposite ends of the stranded wires 17 and 18 are brazed into counter-flanges 19 and 20 respectively, which, for this purpose, contain the same number of axially extending drilled holes as in the flanges 9 and 11. Each of the two counter-flanges 19 and 20 is provided with a peripheral cooling-medium duct 21 and 22 respectively, each of which is again closed off by a sealing ring 23 and 24 respectively. Located between the counter-flanges 19 and 20 is a distance ring 25, which is made of an insulating material and to which the counter-flanges 19 and 20 are welded to form a rigid group of components.

Current conductors 26 and 27 lead to the counter-flanges 19 and 20 respectively; these conductors also constitute cooling-medium pipes and are provided with connections 28 and 29 respectively for receiving hoses.

In relation to the axis A—A of the system, the entire arrangement is substantially axially symmetrical with the exception of the downwardly leading connections for current and cooling water. The parts of differing polarity which receive current are surrounded by a hood to prevent them from being touched.

In FIG. 2, parts similar to those of FIG. 1 carry the same reference numerals as in the latter Figure; FIG. 2 also illustrates the opposite end of the axis A—A of the system. At this end of the heavy-current connection, the outer cavity 5 is closed off by a member 31 made of insulating material and provided with two pairs of radial channels, not referenced, in which sealing rings are fitted. The member 31 made of insulating material is clamped to the outer tube 3 by means of draw-in bolts 32. Leading from the outer tube is a radial port 33 which is surrounded by an insulating tube 34 and extends to a connecting flange 35 which is here closed off by a blind flange 36. The port 33 serves not only for transmitting the current, but also for conveying the cooling medium, and for this purpose it is provided with a bore 37.

A further connecting flange 38 is screwed to the member 31 of insulating material, which is of axially symmetrical shape; this flange is connected to the inner tube 2 in an electrically conducting manner by way of a cylindrical extension 39. The connecting flange 38 likewise serves for transmitting the operating current as well as the cooling medium. For this purpose, the extension 39 has a bore 40, which is flush with the inner cavity 4. The connecting flange 38 is closed off by a blind flange 41.

When the system is connected to the movable consumer unit, for example to an induction melting installation that is to be supplied at medium frequency, the blind flanges 36 and 41 are removed and replaced by suitable counter-flanges, which are connected to the consumer unit. Thus, the consumer unit constitutes the extension of the heavy-current connection, i.e. the consumer unit closes not only the current circuit but the cooling-medium circulating system. For example, the blind flanges 36 and 41 can be thought of as being replaced by the connecting flanges of a hollow induction coil in which a melting crucible is located. This melting crucible will usually comprise what is known as a pouring lip, by way of which the contents of the crucible can be emptied into a casting mould by tilting the crucible. The swivelling movement necessary for this purpose is achieved by means of the above-described heavy-current connection. That end of the heavy-current connection that is illustrated in FIG. 2 is protected by an insulating cover.

I claim:

1. In a rotatable connector for heavy electrical currents having first and second fluid-cooled conductors, a first flange unit having first and second electrically conducting flanges insulated from each other and physically and electrically connected respectively to the first and second conductors, a second flange unit which is annular and generally coaxially receives in the annular space thereof the first flange unit for relative rotation therebetween, the second flange unit having first and second electrically conducting flanges insulated from each other, the improvement comprising, in combination;

projection means on the first flange of the first flange unit for direct thermal communication of the first flange with the fluid cooling the first conductor connected thereto;

cooling means for providing a cooling fluid inside the second flange of the first flange unit and both flanges of the second flange unit; and at least two U-shaped stranded wires each embedded at opposite ends of the U thereof in respective pairs of the first and second flanges of the first and second flange units, first flange to first flange and second flange to second flange, whereby the projection means and cooling means in combination with the embedding of the ends of the U-shaped stranded wires keeps the latter cool enough to carry heavy electrical currents without corroding contact between the stranded wires and cooling fluid.

2. The rotatable connector of claim 1, wherein the ends of the U-shaped stranded wires are brazingly embedded.

3. In a rotatable connector for passing heavy electrical currents between relatively rotatable components, the connector having inner and outer coaxial current-carrying tubes, the inner tube being radially spaced inside the outer tube; a first flange unit having a first electrically-conducting, annular flange physically and electrically connected on one side to an end of the outer tube, an electrically-insulating, annular distance element having one side connected to the other side of the first flange, and a second electrical-conducting, annular flange connected to the other side of the electrically-insulating distance element and electrically and physically connected inside its annular opening to the inner tube, the annular openings of the flanges and distance element being coaxial for passing the axis of inner tube to the second flange for the connections thereto; means between the annular opening of the first flange and the inner tube at least where the latter projects through the former for electrically insulating the same; a second flange unit having first and second electrically-conducting, annular flanges and an electrically-insulating, annular distance element the annular openings of each thereof being generally coaxial to each other and generally coaxial of the first flange unit and receiving the latter generally within the annular openings of the second flange unit; means for supporting the tubes and first flange unit, and the second flange unit for relative rotation generally about the axis thereof; and means for supplying the inside of the inner tube and the radial space between the inner and outer tubes with a cooling fluid, the improvement comprising, in combination:

projection means on the first flange of the first flange unit extending to the radial space between the inner and outer tubes for direct thermal communication of the first flange with the cooling fluid in the radial space;

cooling means for providing a cooling fluid inside the second flange of the first flange unit and both flanges of the second flange unit; and at least two U-shaped stranded wires each embedded at opposite ends of the U thereof in respective pairs of the first and second flanges of the first and second flange units, first flange to the first flange and second flange to second flange, whereby the projection means and cooling means in combination with the embedding of the ends of the U-shaped stranded wires keeps the latter cool enough to carry heavy electrical currents without corroding contact between the stranded wires and cooling fluid.

* * * * *